US010094179B2

(12) United States Patent
Ottersland

(10) Patent No.: US 10,094,179 B2
(45) Date of Patent: Oct. 9, 2018

(54) REPLACABLE DIES

(71) Applicant: MHWIRTH AS, Kristiansand (NO)

(72) Inventor: Gjerulf Ottersland, Kristiansand (NO)

(73) Assignee: MHWIRTH AS, Kristiansand (NO)

( * ) Notice: Subject to any disclaimer, the term of this patent is extended or adjusted under 35 U.S.C. 154(b) by 390 days.

(21) Appl. No.: 14/781,590

(22) PCT Filed: Apr. 1, 2014

(86) PCT No.: PCT/IB2014/000679
§ 371 (c)(1),
(2) Date: Oct. 1, 2015

(87) PCT Pub. No.: WO2014/162202
PCT Pub. Date: Oct. 9, 2014

(65) Prior Publication Data

US 2016/0060984 A1 Mar. 3, 2016

(30) Foreign Application Priority Data

Apr. 4, 2013 (NO) ..... 20130455

(51) Int. Cl.
*E21B 19/16* (2006.01)
*E21B 19/06* (2006.01)
*E21B 31/20* (2006.01)

(52) U.S. Cl.
CPC ..... *E21B 19/161* (2013.01); *E21B 19/06* (2013.01); *E21B 31/20* (2013.01)

(58) Field of Classification Search
CPC ..... E21B 19/06; E21B 19/161; E21B 31/20
See application file for complete search history.

(56) References Cited

U.S. PATENT DOCUMENTS 1,909,601 A 5/1933 Young et al.
2,068,217 A * 1/1937 Abegg ..... E21B 19/10 188/67
3,748,702 A 7/1973 Brown
4,934,869 A 6/1990 Brandon et al.
(Continued)

FOREIGN PATENT DOCUMENTS

NO 319959 B1 10/2005
NO 20092552 A1 7/2009
NO 332866 B1 1/2013

*Primary Examiner* — Caroline N Butcher
(74) *Attorney, Agent, or Firm* — Norman B. Thot

(57) ABSTRACT

A device which moves a die between a retracted position, thereby releasing the die from the device, and an advanced position, thereby fixing the die to the device. The device includes an inner body comprising an inner body wall, and an inner body set of inclined faces. A body comprises a longitudinal groove. The longitudinal groove comprises an inner wall which contacts the inner body wall. An intermediate body comprises a first longitudinal side comprising a longitudinal side set of inclined faces, and a second longitudinal side arranged opposite thereto. The first longitudinal side cooperates with the inner wall. The second longitudinal side cooperates with a first side of the die. The longitudinal side set of inclined faces cooperates with the inner body set of inclined faces. A relative movement between the intermediate body and the inner body moves the die between the retracted position and the advanced position.

8 Claims, 6 Drawing Sheets

(56) References Cited

U.S. PATENT DOCUMENTS

| | | | | |
|---|---|---|---|---|
| 6,637,296 | B1 * | 10/2003 | Dagenais | E21B 19/161 81/185.1 |
| 7,926,577 | B2 * | 4/2011 | Thomas | E21B 19/10 166/380 |
| 2002/0108748 | A1 | 8/2002 | Keyes | |
| 2005/0034566 | A1 * | 2/2005 | Bangert | E21B 19/161 81/57.33 |
| 2006/0027047 | A1 | 2/2006 | Buck | |
| 2006/0174729 | A1 | 8/2006 | Slettedal et al. | |
| 2011/0048739 | A1 | 3/2011 | Blair et al. | |

* cited by examiner

REPLACABLE DIES

CROSS REFERENCE TO PRIOR APPLICATIONS

This application is a U.S. National Phase application under 35 U.S.C. § 371 of International Application No. PCT/IB2014/000679, filed on Apr. 1, 2014 and which claims benefit to Norwegian Patent Application No. 20130455, filed on Apr. 4, 2013. The International Application was published in English on Oct. 9, 2014 as WO 2014/162202 A2 under PCT Article 21(2).

FIELD

The present invention relates to a device for holding or gripping a pipe, such as a drill pipe or the like. A device with replaceable dies is described. The device is especially useful in connection with so-called gripping tongs or gripping jaws that are used in connection with pipe handling. Such devices are in particular used to move pipes between different stations on a deck.

BACKGROUND

In the field of offshore technology, more specifically, in connection with so-called torque tongs or power tongs which are utilized when making up drill strings used to drill wells in search of hydrocarbons (oil and gas), it is usual to use such tongs to screw together/unscrew joints of drill pipe. These tongs are also referred to as iron roughnecks. Usually, an upper pipe part is held by a gripping device, while a lower pipe part is set in rotation by a power tong/torque tong. Another solution uses a so-called slips in the drill floor, and optionally a lower power tong, to hold a lower pipe string in position relative to an upper pipe string that is rotated using a rotary device such as a torque tong, a drilling machine, or the like. The torque tong consists of a jaw which has dies. The task of the dies is to hold the pipe firmly in the torque tong and to prevent rotation of the pipe during its assembly with other pipes. The dies are therefore subjected to substantial forces and must be replaced at regular intervals due to wear. An example of an iron roughneck is described in NO 319959 B1 where a die is mounted on each of three displaceable clamping devices. The die is equipped with a plurality of relatively sharp ridges that are clamped against the pipe wall and thus grip it.

NO 20092552 describes a replaceable die for torque tongs/power tongs. A holding means for a die is described comprising a body having longitudinal grooves with internal walls for contact with corresponding surfaces on the die, where a first wall is movable between a retracted position in the groove in which the die is released and an advanced position in the groove in which the jaw is gripped in contact with the internal walls. It is further described that the first wall comprises an outer surface on a wedge-shaped element with a first face inclined relative to the first wall and arranged on an opposite side of the first wall, and where the first inclined face is in contact with an opposing and corresponding second inclined face. A relative movement between the first and second inclined faces causes the first wall to move between the corresponding retracted and advanced positions. The groove itself is thereby configured as a wedge in which a mounted wedge-shaped element is placed.

The groove and the die must be configured with a minimum of play so that the die sits firmly in the groove. This is not necessarily compatible with the harsh environment in which the device is operated, i.e., an environment with a great deal of pollution from oil, dirt, dust etc., which can result in the small clearances in the groove becoming blocked and the die becoming jammed. This can lead to the dies sticking when they are to be replaced, which results in an increased expenditure of time.

Prior art dies therefore have a tendency to become jammed and can be difficult to replace when they are worn.

A need therefore exists to provide an improved device to replace dies which remedies or reduces at least one of the disadvantages of the prior art.

SUMMARY

An aspect of the present invention is to provide a device that reduces the expenditure of time and simplifies work when replacing dies.

In an embodiment, the present invention provides a device configured to move a die comprising a first side between a retracted position in which the die is released from the device, and an advanced position in which the die is fixed to the device. The device includes an inner body comprising an inner body wall, and an inner body set of inclined faces. A body comprises a longitudinal groove. The longitudinal groove comprises an inner wall which is configured to contact with the inner body wall of the inner body. An intermediate body comprises a first longitudinal side comprising a longitudinal side set of inclined faces, and a second longitudinal side arranged opposite to the first longitudinal side. The first longitudinal side is arranged to cooperate with the inner wall of the inner body. The second longitudinal side is arranged to cooperate with the first side of the die. The longitudinal side set of inclined faces is configured to cooperate with the inner body set of inclined faces. A relative movement between the intermediate body and the inner body moves the die between the retracted position and the advanced position.

BRIEF DESCRIPTION OF THE DRAWINGS

The present invention is described in greater detail below on the basis of embodiments and of the drawings in which.

DETAILED DESCRIPTION

Figure 1:
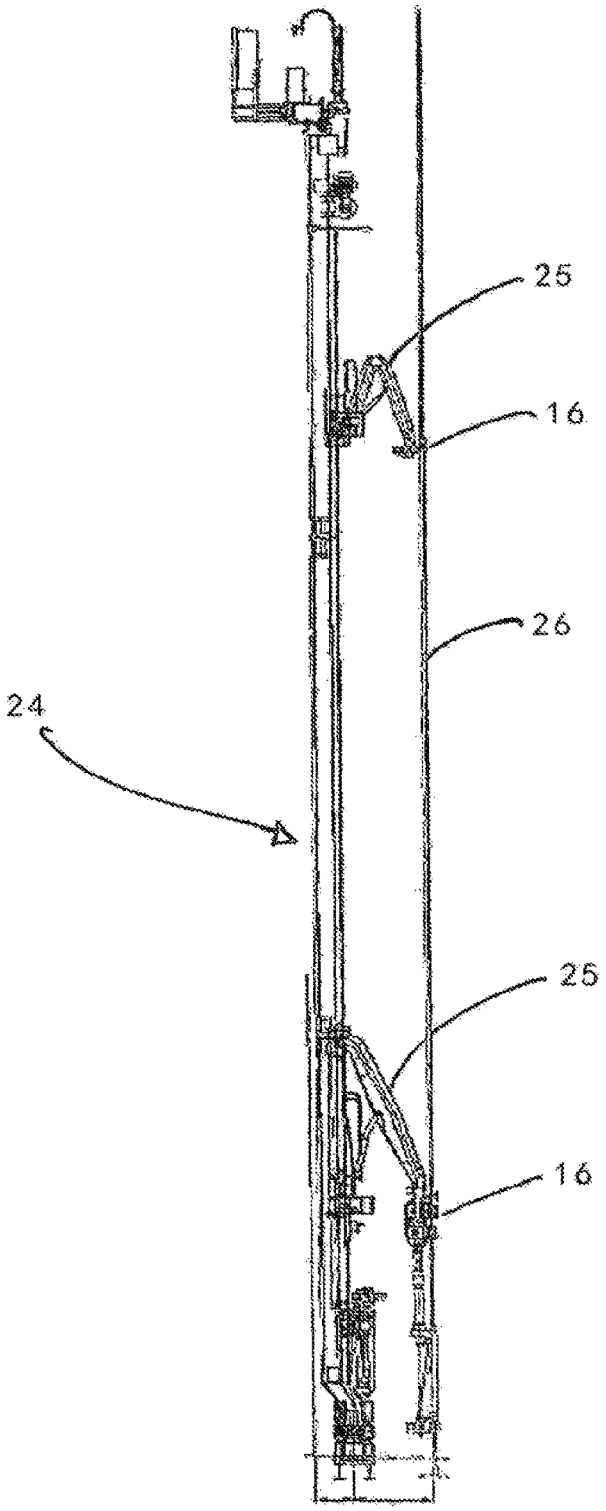
FIG. 1 shows an arrangement in which the present invention can be used.

The present invention relates to a device, such as a replaceable die, which can be used in gripping jaws, gripping holders, torque tongs, power tongs, or any device used for offshore or onshore pipe handling.

The present invention relates to a die device where the die is movable between a retracted position in which the die is released, and an advanced position in which the die is fixed, and wherein the device comprises: a body with a longitudinal groove, the groove having internal walls for contact with corresponding walls on an inner body, an intermediate body arranged for cooperation with the inner body on a first longitudinal side thereof, and for cooperation with a first side of the die on an oppositely located second longitudinal side thereof, which intermediate body, on its first longitudinal side, is provided with a first set of inclined faces operable for cooperation with a corresponding second set of inclined faces on the inner body, and where a relative movement between the intermediate body and the inner body causes the die to be moved between the retracted position and the advanced position.

In an embodiment of the device of the present invention, the first set of inclined faces and the second set of inclined faces can, for example, be provided with cooperating faces, which cooperating faces are moved relative to each other by a longitudinal movement of the intermediate body and thus, in a first longitudinal direction of travel, move the die towards the retracted position and, in an oppositely directed second longitudinal direction of travel, move the die towards the advanced position.

In an embodiment of the device of the present invention, the intermediate body can, for example, further comprise a transfer element where a movement of the transfer element causes the relative movement between the first set of inclined faces and the second set of inclined faces.

In an embodiment of the device of the present invention, the first set of inclined faces and the second set of inclined faces can, for example, be oppositely directed so that a relative movement between the sets will provide a greater radial extent of the inner body and the intermediate body in one relative axial movement of the transfer element, and a smaller radial extent of the inner body and the intermediate body in an opposite axial movement of the transfer element, which axial movements can cause the die to be moved to the advanced position and the retracted position.

In an embodiment of the device of the present invention, the device can, for example, further comprise a second screw and locking washer, where the second screw is arranged to lock the locking washer in a specific position, and the locking washer is arranged to lock the transfer element when the die is in the advanced position.

The present invention also relates to a method for changing a die as disclosed above, where the die is arranged in a body, the method comprising the steps of:

- unscrewing a second screw to cause a locking washer to be disengaged from locking engagement with a transfer element;
- rotating the transfer element, which transfer element causes an intermediate body to be moved axially relative to an inner body so that the die is moved from an advanced position, in which the die is fixed, to a retracted position in which the die is released; and
- subsequently removing the die from the body through a replacement hole.

A non-limiting embodiment of the present invention will now be described with reference to the accompanying drawings in which like parts have been given like reference numerals.

FIG. 1 shows a lifting apparatus 24 in which the present invention can be used. The lifting apparatus 24 can comprise a plurality of arms 25 with gripping jaws 16 at the outer ends to lift pipes 26.

Figure 2:
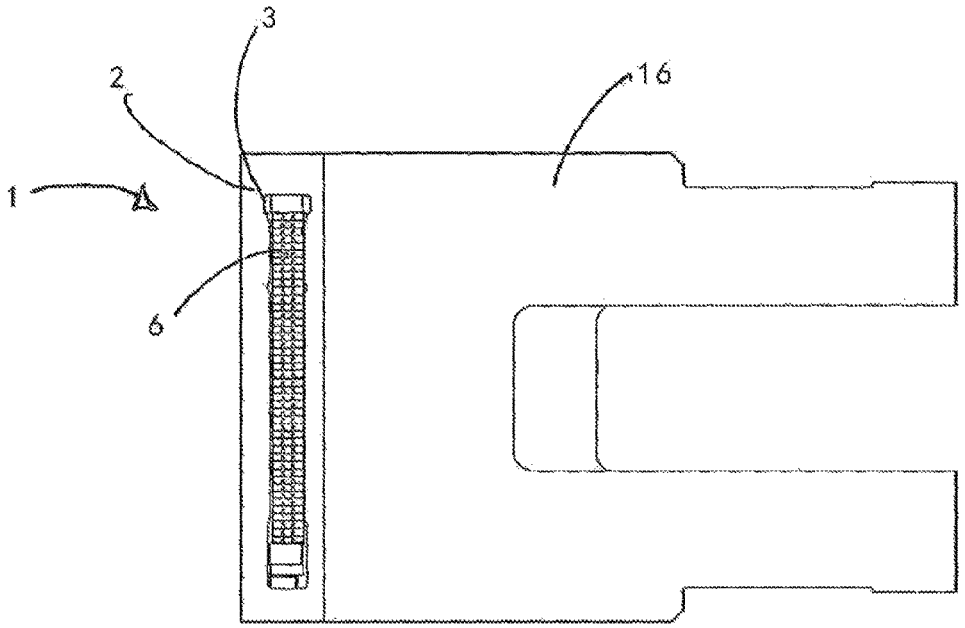
FIG. 2 shows a part of a gripping jaw in which the present invention can be used.

FIG. 2 shows an embodiment of a gripping jaw 16 according to the present invention. The gripping jaw 16 comprises a body 2 with a longitudinal groove 3 in which a die 6 (the illustrated embodiment shows four single dies which together are designated as one die 6) is arranged. Each gripping jaw 16 can be provided with one or more dies 6.

Figure 3:
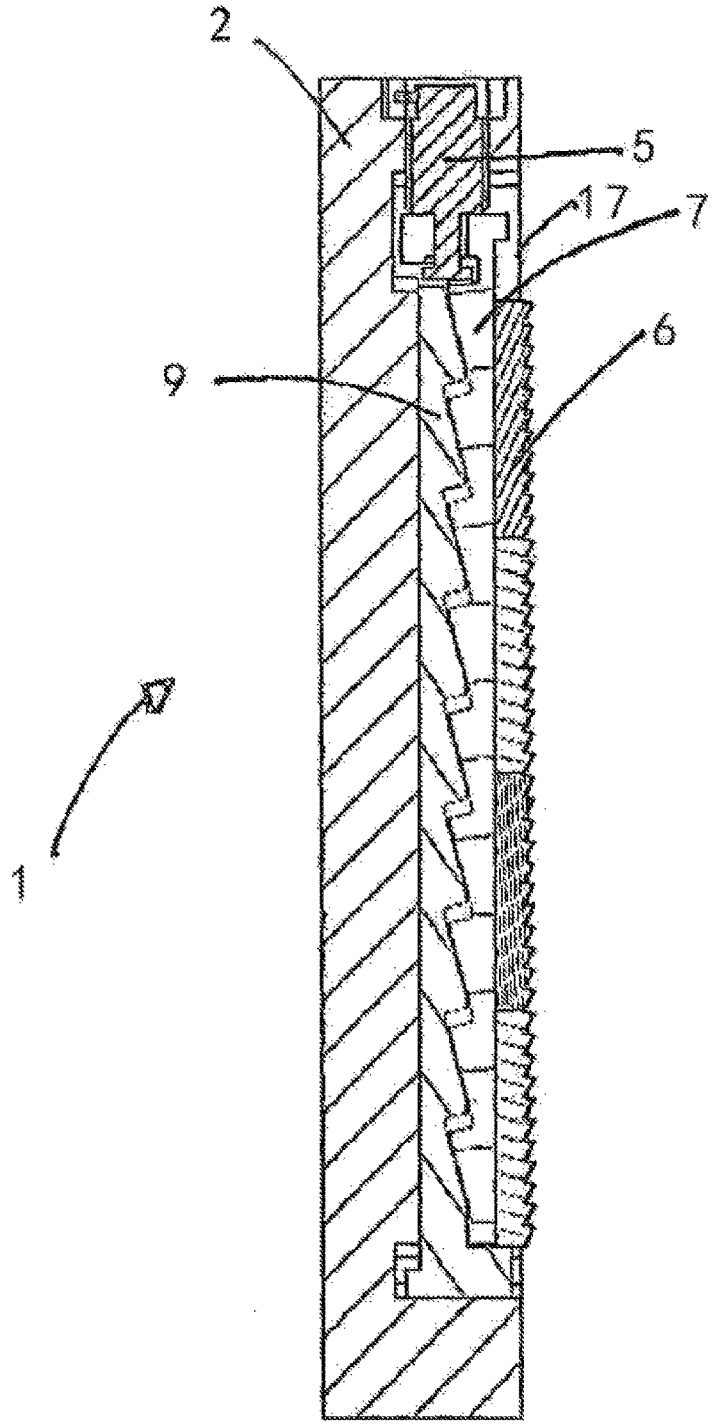
FIG. 3 shows a side view of an embodiment of the device according to the present invention.
Figure 4:
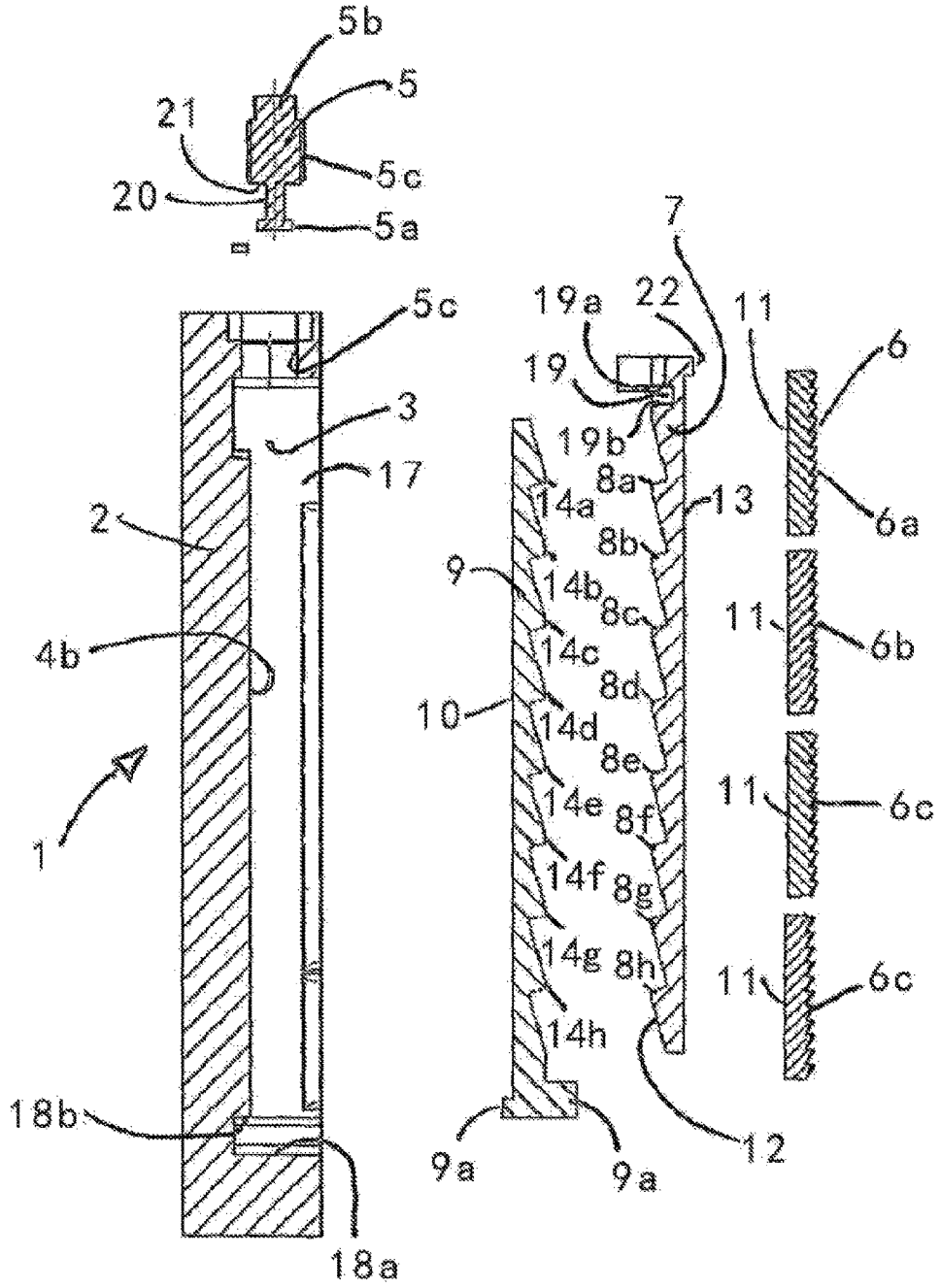
FIG. 4 shows a perspective sectional view of the device in FIG. 3.

FIGS. 3 and 4 show, respectively, a side view and a perspective sectional view of an embodiment of the device 1 according to the present invention. A part of a gripping jaw 16 (compare FIG. 2) is shown with a die 6, which die 6 is made up of a plurality of small die elements 6*a-d*. The die 6 is movable between a retracted position in which the die 6 is released, and an advanced position in which the die 6 is fixed in the longitudinal groove 3 in the body 2. In the advanced position, the die 6 will rest against inclined opposing faces (not shown in the drawings) in the longitudinal groove 3. The inclined opposing faces may exhibit a trapezoid or dovetail shape in cross-section when seen from above. The body 2 is an integral part of the gripping jaw 16, or may optionally be connected to the gripping jaw 16. The longitudinal groove 3 has a lower abutment surface 18*a* which stops a longitudinal movement of elements arranged in the longitudinal groove 3. The longitudinal groove 3, at a lower end, is further configured with a recess in the radial direction which forms an upper abutment surface 18*b*. Radially outside the inner body 9, but still lying in the longitudinal groove 3, there is arranged an intermediate body 7. The intermediate body 7 is arranged to cooperate with the inner body 9 on a first longitudinal side 12 thereof, and to cooperate with a first side 11 of the die 6 on an oppositely located second longitudinal side 13 thereof. The intermediate body 7 is provided with a complementary flange 9*a* that cooperates with upper and lower abutment surfaces 18*a*, 18*b* in the longitudinal groove 3 so as to stop the movement of the inner body 9. One side of the complementary flange 9*a* will cooperate with upper and lower abutment surfaces 18*a*, 18*b*, whilst an opposite side of the complementary flange 9*a* will form a stop in the axial direction for the intermediate body 7. The intermediate body 7 is configured with a recess 19 having upper and lower contact faces 19*a*, 19*b* to cooperate with a collar 5*a* on a transfer element 5. The collar 5*a* also has a function as an upper stop for countering the axial movement of the inner body 9. The transfer element 5 further comprises an indentation 20 defined by the collar 5*a* at one end thereof, and an upper stop surface 21 at its upper end. This results in any movement of the transfer element 5 causing a corresponding movement of the intermediate body 7 in the same direction. The intermediate body 7 is furthermore configured with an upper stop collar 22 that prevents an axial displacement of the die 6 when the die 6 is in the advanced position.

The intermediate body 7 is provided with a first set of inclined faces 8*a-h* that are operable to cooperate with a corresponding second set of inclined faces 14*a-h* on the inner body 9. The first and the second set of inclined faces 8*a-h*, 14*a-h* act as wedges against one another in the illustrated embodiment. A relative movement of the intermediate body 7 relative to the inner body 9 causes the die 6 to be moved between the retracted position and the advanced position. The movement of the intermediate body 7 can, for example, be made by using the transfer element 5. The transfer element 5 is connected to an upper end of the intermediate body 7 so that a rotation of a first screw 5*b* on the top of the transfer element 5 (integral in transfer element 5) will transfer a movement to the intermediate body 7. The transfer element 5 and the body 2 are configured with complementary threads 5*c* for the screwing in and out of the transfer element 5.

The inner body 9 is provided with a inner body wall (10) which rests substantially firmly against the inner walls 4*b* in the longitudinal groove 3 (they are allowed a slight axial displacement by the complimentary flange 9*a* in between the upper and the lower abutment surface 18*a*, 18*b*) so that a downward movement (in the specific embodiment) of the transfer element 5, and hence the intermediate body 7, will force the first and second inclined faces 8*a-h*, 14*a-h* to be moved along each other and result in the oppositely located second longitudinal side 13 of the intermediate body 7 to push against the first side 11 of the die 6 and exert a force on the die 6 that pushes it into the advanced position (operational position).

An operator can easily change the die 6 if it begins to be worn for some reason, or must be replaced for other reasons. By operating the second screw 15 and releasing the die 6 as a result of an upward movement of the intermediate body 7 relative to the inner body 9, the first and second inclined faces 8*a-h*, 14*a-h*, on the respective intermediate body 7 and inner body 9, will be moved into a position in which the wedging they have formed will be released. This results in the force acting from the oppositely located second longitudinal side 13 of the intermediate body 7 on the first side 11 of the die 6 being reduced, and the die 6 being moved to the retracted position in which it is released. From the retracted position, the die 6 can easily be taken out and changed, through suitable slots, such as replacement hole 17 arranged at an upper end of the longitudinal groove 3.

Figure 5:
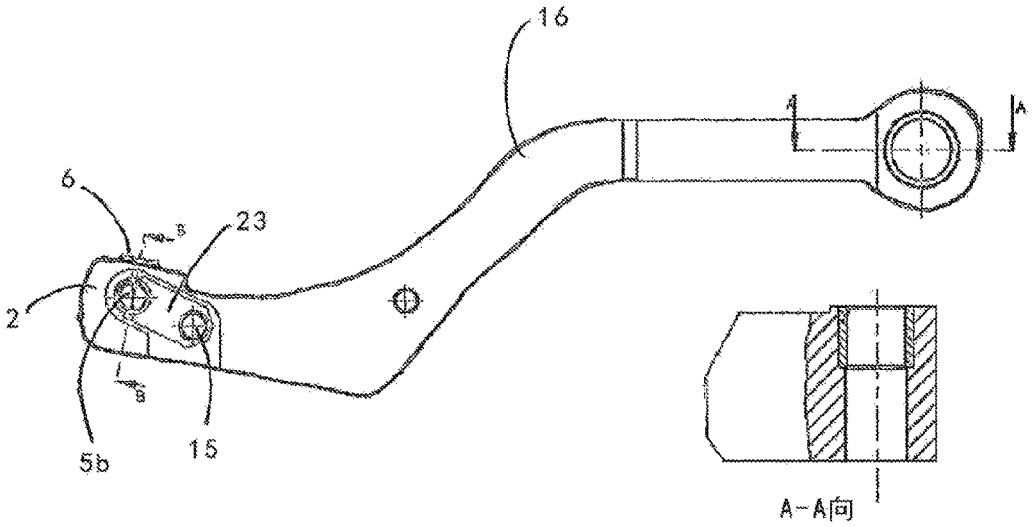
FIG. 5 shows a top view of the device in FIG. 2.
Figure 6:
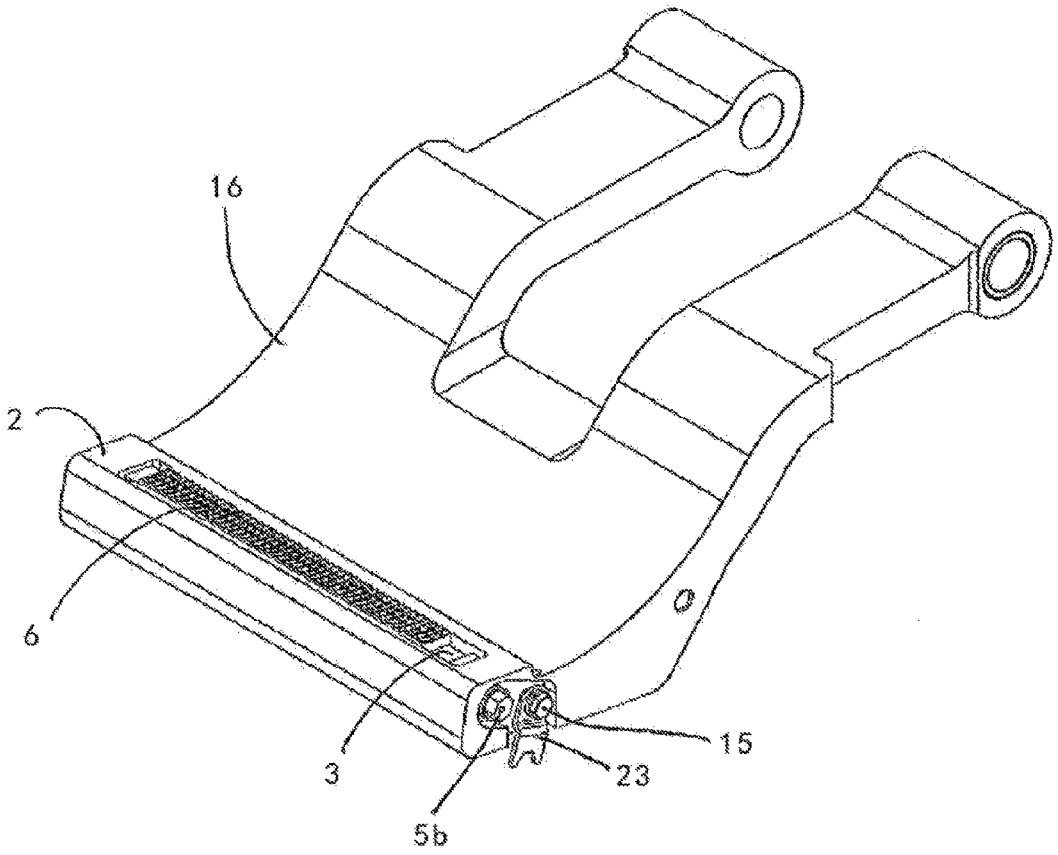
FIG. 6 shows an oblique side view of an embodiment of the device according to the present invention.

When the transfer element 5 is screwed into its operating position, i.e., the advanced position for the die 6, the transfer element 5 can be locked in that position to prevent it from rotating. This can, for example, be done by a locking washer 23 that is held in place by a second screw 15, as is shown in FIGS. 5 and 6.

The procedure is reversed when the die 6 must be replaced: first the second screw 15 is unscrewed to release the locking washer 23, then the transfer element 5 is unscrewed from its operating position so that the die 6 can be replaced through the replacement hole 17.

The embodiment described herein should be regarded as non-limiting. A person of skill in the art can make modifications or changes to the present invention without departing from the scope of the present invention as defined in the attached claims. Reference should also be had to the appended claims.

What is claimed is:

1. A device configured to move a die, the device comprising:

an inner body comprising an inner body wall, and an inner body set of inclined faces;

a body comprising a longitudinal groove, the longitudinal groove comprising an inner wall which is configured to contact with the inner body wall of the inner body; and an intermediate body comprising, a first longitudinal side comprising a longitudinal side set of inclined faces, and a second longitudinal side arranged opposite to the first longitudinal side, wherein, the first longitudinal side is arranged to cooperate with the inner wall of the inner body, the second longitudinal side is arranged to cooperate with the first side of the die, and the longitudinal side set of inclined faces is configured to cooperate with the inner body set of inclined faces, wherein, a relative axial movement between the intermediate body and the inner body moves the die between a retracted position in which the die is released so as to be removable from the device and an advanced position in which the die is fixed, via the intermediate body, to the longitudinal groove in the body.

2. The device as recited in claim 1, wherein, the longitudinal side set of inclined faces comprises faces, the inner body set of inclined faces comprises faces, and a longitudinal movement of the intermediate body moves the faces of the longitudinal side set of inclined faces and the faces of the inner body set of inclined faces relative to each other so that, in a first longitudinal direction of travel, the die is moved into the retracted position and, in a second longitudinal direction of travel which is opposite to the first longitudinal direction of travel, the die is moved into the advanced position.

3. A device as recited in claim 2, wherein, the intermediate body further comprises a transfer element, and a movement of the transfer element moves the faces of the longitudinal side set of inclined faces and the faces of the inner body set of inclined faces relative to each other.

4. The device as recited in claim 3, wherein, the longitudinal set of inclined faces and the inner body set of inclined faces are arranged so as to be oppositely directed to each other so the movement of the longitudinal side set of inclined faces and the inner body set of inclined faces relative to each other results in a first radial movement of the inner body and the intermediate body in a first axial movement of the transfer element, and in a second radial movement of the inner body and the intermediate body in a second axial movement of the transfer element which is opposite to the first axial movement, the first radial movement being opposite to the second radial movement, the first axial movement causes the die to be moved to the advanced position, and the second axial movement causes the die to be moved to the retracted position.

5. The device as recited in claim 3, wherein the device further comprises:

a screw; and a locking washer, wherein, the screw is configured to lock the locking washer in a position, and the locking washer is configured to lock the transfer element when the die is in the advanced position.

6. A method for changing a die arranged in a body, the method comprising:

providing a device comprising:

an inner body;

a body comprising a replacement hole;

an intermediate body comprising a transfer element;

a screw; and a locking washer, wherein, a relative movement between the intermediate body and the inner body moves the die between a retracted position, in which the die is removable, and an advanced position, in which the die is not removable, the screw is configured to lock the locking washer in a locking engagement with the transfer element, and the locking washer is configured to lock the transfer element when the die is in the advanced position;

unscrewing the screw to unlock the locking washer from the locking engagement with the transfer element;

rotating the transfer element so that the intermediate body is moved axially relative to the inner body, thereby moving the die to be replaced from the advanced position to the retracted position so as to release the die; and removing the die from the body through the replacement hole.

7. The method as recited in claim 6, further comprising:

inserting a new die into the body through the replacement hole;

rotating the transfer element so that the intermediate body is moved axially relative to the inner body, thereby moving the new die from the retracted position to the advanced position so as to fix the new die; and screwing the screw to lock the locking washer into the locking engagement with the transfer element.

8. A device configured to move a die, the device comprising:

an inner body comprising an inner body wall, and an inner body set of inclined faces;

a body comprising a replacement hole and a longitudinal groove, the longitudinal groove comprising an inner wall which is configured to contact with the inner body wall of the inner body; and an intermediate body comprising, a first longitudinal side comprising a longitudinal side set of inclined faces, a second longitudinal side arranged opposite to the first longitudinal side, and a transfer element, wherein, the first longitudinal side is arranged to cooperate with the inner wall of the inner body, the second longitudinal side is arranged to cooperate with the first side of the die, and the longitudinal side set of inclined faces is configured to cooperate with the inner body set of inclined faces, wherein, a relative axial movement between the intermediate body and the inner body moves the die between, a retracted position in which the die is released so as to be removable from the device through the replacement hole, and an advanced position in which the die is fixed, via the intermediate body, to the longitudinal groove in the body, and the relative axial movement is preformed via a rotation of the transfer element.

* * * * *